US010729606B2

(12) United States Patent
Hood et al.

(10) Patent No.: US 10,729,606 B2
(45) Date of Patent: Aug. 4, 2020

(54) ADAPTIVE MOBILITY LIFT

(71) Applicant: Liko Research & Development AB, Luleå (SE)

(72) Inventors: Michael Scott Hood, Batesville, IN (US); Timothy Allen Lane, Greensburg, IN (US); Neal Wiggermann, Batesville, IN (US); Timothy D. Wildman, Metamora, IN (US); Robert M. Zerhusen, Cincinnati, OH (US)

(73) Assignee: Liko Research & Development AB, L'uleå (SE)

( * ) Notice: Subject to any disclaimer, the term of this patent is extended or adjusted under 35 U.S.C. 154(b) by 617 days.

(21) Appl. No.: 15/142,660

(22) Filed: Apr. 29, 2016

(65) Prior Publication Data

US 2016/0331618 A1 Nov. 17, 2016

Related U.S. Application Data

(60) Provisional application No. 62/161,954, filed on May 15, 2015.

(51) Int. Cl.
*A61G 7/10* (2006.01)

(52) U.S. Cl.
CPC ..... *A61G 7/1046* (2013.01); *A61G 7/108* (2013.01); *A61G 7/1017* (2013.01); *A61G 2203/32* (2013.01); *A61G 2203/44* (2013.01); *A61H 2201/5007* (2013.01); *A61H 2201/5061* (2013.01)

(58) Field of Classification Search
CPC .... A61G 7/1046; A61G 7/108; A61G 7/1017; A61G 2203/44; A61G 2203/32; A61H 2201/5061; A61H 2201/5007
See application file for complete search history.

(56) References Cited

U.S. PATENT DOCUMENTS 2,565,536 A * 8/1951 Valentine ..... A61G 7/1017 5/84.1
3,940,808 A * 3/1976 Petrini ..... A61G 7/1019 5/83.1

(Continued)

FOREIGN PATENT DOCUMENTS

EP 1589923 A1 11/2005
EP 2684549 A2 1/2014

(Continued)

OTHER PUBLICATIONS

Extended Search Report issued in EP Application No. 16169446.8-1651 dated Sep. 26, 2016, 7 pages.

*Primary Examiner* — David R Hare
*Assistant Examiner* — Alexis Felix Lopez
(74) *Attorney, Agent, or Firm* — Dinsmore & Shohl LLP

(57) ABSTRACT

An adaptive lift includes a base portion including a plurality of rollers, a lift portion coupled to the base portion, the lift portion including a mast extending upward from the base portion in a vertical direction and a lift arm coupled to the mast, a lift bar coupled to the lift arm, a lift system coupled to the base portion and the lift arm, where the lift system raises and lowers the lift bar with respect to the base portion, a support arm pivotally coupled to the mast and positioned above the base portion in the vertical direction, and a braking system coupled to the support arm, the braking system including a release handle that selectively repositions the braking system between an engaged position, in which the braking system prevents rotation of the plurality of rollers, and a disengaged position, in which the plurality of rollers may rotate.

17 Claims, 10 Drawing Sheets

(56) References Cited

U.S. PATENT DOCUMENTS

| | | | | |
|---|---|---|---|---|
| 4,644,595 | A * | 2/1987 | Daniel | A61G 7/0533 5/83.1 |
| 5,257,425 | A * | 11/1993 | Shinabarger | A61G 7/10 5/507.1 |
| 5,758,371 | A * | 6/1998 | VanDyke | A61G 7/1015 5/86.1 |
| 6,289,534 | B1 | 9/2001 | Hakamiun et al. | |
| 7,354,382 | B1 * | 4/2008 | Warren, II | A61G 7/1017 482/68 |
| 7,634,825 | B2 * | 12/2009 | Chepurny | A61G 7/1015 5/83.1 |
| 8,474,794 | B2 * | 7/2013 | Liljedahl | A61G 7/1017 254/120 |
| 8,910,325 | B2 * | 12/2014 | Faucher | A61G 7/1042 212/278 |
| 2003/0011228 | A1 * | 1/2003 | Komura | A61G 5/14 297/344.12 |
| 2008/0042404 | A1 * | 2/2008 | Mariani | A61G 7/1005 280/657 |
| 2010/0224841 | A1 | 9/2010 | Liljedahl | |
| 2012/0018689 | A1 | 1/2012 | Chepurny et al. | |
| 2013/0174339 | A1 | 7/2013 | Stryker et al. | |
| 2014/0115778 | A1 * | 5/2014 | Ng | A61G 7/1015 5/83.1 |
| 2014/0165287 | A1 * | 6/2014 | Jessen | A61G 7/1019 5/86.1 |
| 2016/0262967 | A1 * | 9/2016 | Mitchell | A61G 7/1017 |

FOREIGN PATENT DOCUMENTS

| | | | |
|---|---|---|---|
| WO | WO2013106314 | A1 | 7/2013 |
| WO | 2015024569 | A1 | 2/2015 |

* cited by examiner

ADAPTIVE MOBILITY LIFT

CROSS REFERENCE TO RELATED APPLICATIONS

This application claims the benefit of priority under 35 U.S.C. § 119 to U.S. Provisional Application Ser. No. 62/161,954, filed May 15, 2015, and entitled "Adaptive Mobility Lift" the entire disclosure of which is incorporated by reference.

TECHNICAL FIELD

The present disclosure generally relates to patient lift assists, and more particularly to an adaptive mobility lift.

BACKGROUND

Recent medical advances have allowed more patients to survive serious injuries or disease processes than ever before. Unfortunately, the period of bed rest required for recovery often leads to severe deterioration of muscle strength and a corresponding inability of the patient to support full body weight upon standing. It is challenging for rehabilitation specialists to help these patients regain the ability to stand and begin ambulation, and the challenge is especially great for obese patients. A common technique in conventional practice is to summon as many colleagues as practical to lift and maneuver the weakened patient to a standing position while he or she attempts to bear full weight through the lower extremities. This technique is not only dangerous, because of the risk of a fall, but it is also psychologically degrading for the patient as the activity reinforces the patient's dependence on others.

Lifting devices, such as patient lifts used in the healthcare industry may be utilized to move a patient between various positions, such as moving from a bed to a standing position and moving from a sitting position to a standing position. Patient lifts may be equipped with a sling that is coupled to a lifting arm that is utilized to lift the patient. However, conventional patient lifts may move the patient between the various positions by applying a constant or predetermined force to lift the patient, such that the patient moves between the various positions without supporting themselves.

Accordingly, a need exists for alternative adaptive mobility lifts that selectively provide variable force to lift a patient, thereby allowing the patient to progressively support themselves without assistance.

SUMMARY

In one embodiment, an adaptive lift includes a base portion including a plurality of rollers, a lift portion coupled to the base portion, the lift portion including a mast extending upward from the base portion in a vertical direction and a lift arm coupled to the mast, a lift bar coupled to the lift arm, a lift system coupled to the base portion and the lift arm, where the lift system raises and lowers the lift bar with respect to the base portion in the vertical direction, a support arm pivotally coupled to the mast and positioned above the base portion in the vertical direction, and a braking system coupled to the support arm, the braking system including a release handle that selectively repositions the braking system between an engaged position, in which the braking system prevents rotation of the plurality of rollers, and a disengaged position, in which the plurality of rollers may rotate.

In another embodiment, an adaptive lift system includes a base portion including a plurality of rollers, a lift portion coupled to the base portion, the lift portion including a mast extending upward from the base portion in a vertical direction and a lift arm coupled to the mast, a lift bar coupled to the lift arm, and a lift system coupled to the base portion and the lift arm, where the lift system raises and lowers the lift bar with respect to the base portion in the vertical direction, the lift system including an electronic controller including a processor and a memory storing computer readable and executable instructions, a motor communicatively coupled to the electronic controller, a linking member engaged with the motor, an integrated scale positioned within the lift bar and communicatively coupled to the electronic controller, and a user input communicatively coupled to the electronic controller.

These and additional features provided by the embodiments described herein will be more fully understood in view of the following detailed description, in conjunction with the drawings.

BRIEF DESCRIPTION OF THE DRAWINGS

The embodiments set forth in the drawings are illustrative and exemplary in nature and not intended to limit the subject matter defined by the claims. The following detailed description of the illustrative embodiments can be understood when read in conjunction with the following drawings, where like structure is indicated with like reference numerals and in which:

These and additional features provided by the embodiments described herein will be more fully understood in view of the following detailed description, in conjunction with the drawings.

DETAILED DESCRIPTION

Figure 1:
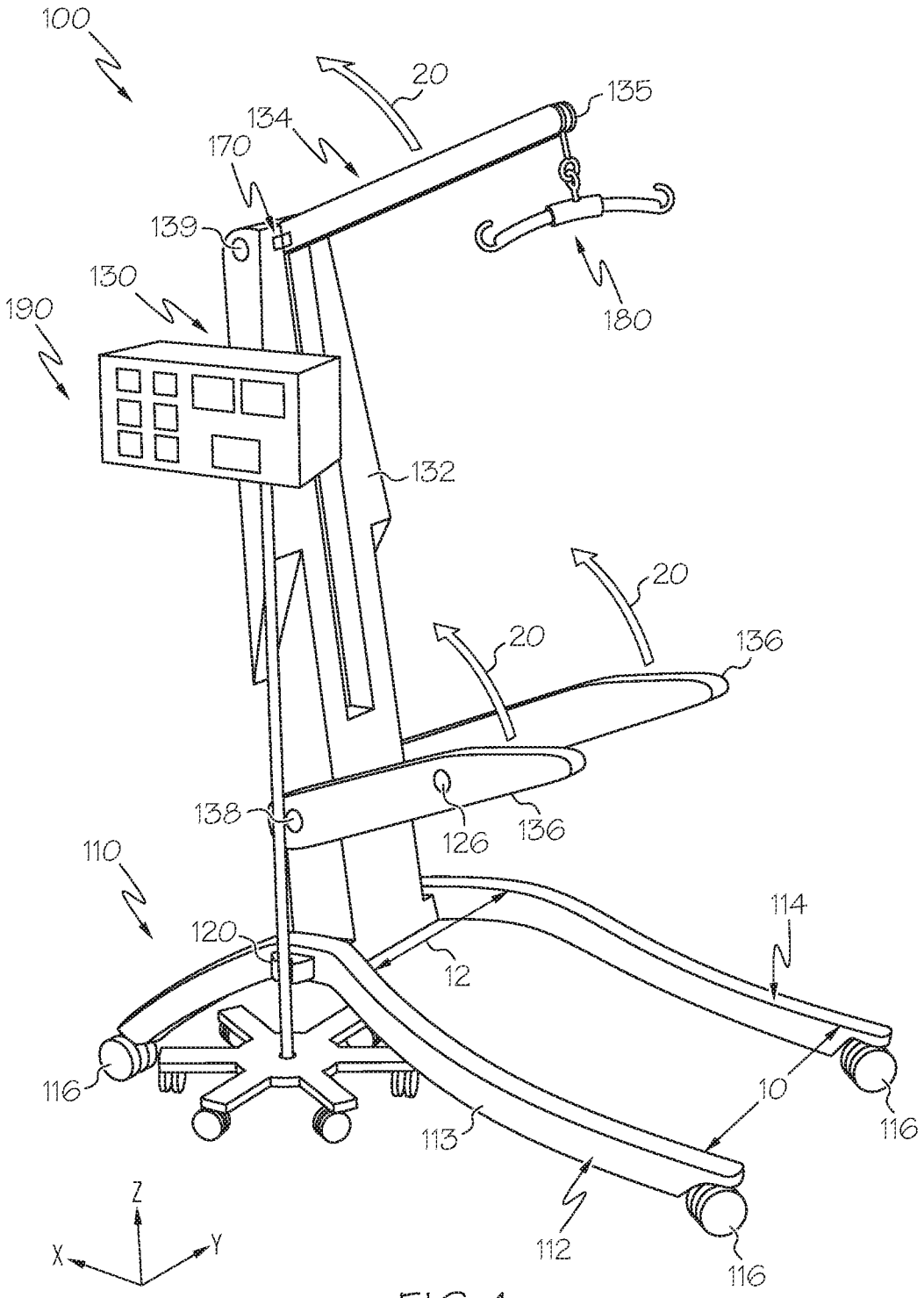
FIG. 1 schematically depicts a perspective view of an adaptive mobility lift according to one or more embodiments shown or described herein.

Reference will now be made in detail to embodiments of adaptive lifts, examples of which are illustrated in the accompanying drawings. Whenever possible, the same reference numerals will be used throughout the drawings to refer to the same or like parts. One embodiment of adaptive lift is depicted in FIG. 1. In one embodiment, an adaptive lift includes a base portion including a plurality of rollers, a lift portion coupled to the base portion, the lift portion including a mast extending upward from the base portion in a vertical direction and a lift arm coupled to the mast. The adaptive lift includes a lift bar coupled to the lift arm, a lift system coupled to the base portion and the lift arm, where the lift system raises and lowers the lift bar with respect to the base portion. The adaptive lift further includes a support arm pivotally coupled to the mast and positioned above the base portion in the vertical direction, and a braking system coupled to the support arm, the braking system including a release handle that selectively repositions the braking system between an engaged position, in which the braking system prevents rotation of the plurality of rollers, and a disengaged position, in which the plurality of rollers may rotate. Adaptive lifts will be described in more detail herein with specific reference to the appended drawings.

As used herein, the term "longitudinal direction" refers to the forward-rearward direction of the lift (i.e., in the +/−X-direction as depicted). The term "lateral direction" refers to the cross-direction of the lift (i.e., in the +/−Y-direction as depicted), and is transverse to the longitudinal direction. The term "vertical direction" refers to the upward-downward direction of the lift (i.e., in the +/−Z-direction as depicted).

The phrase "communicatively coupled" is used herein to describe the interconnectivity of various components of the adaptive lift and means that the components are connected either through wires, optical fibers, or wirelessly such that electrical, optical, and/or electromagnetic signals may be exchanged between the components.

Referring now to FIG. 1, an adaptive lift 100 is schematically depicted. The adaptive lift 100 includes a base portion 110 and a lift portion 130 that includes a mast 132 and a lift arm 134. The base portion 110 includes a first leg 112 and a second leg 114 that extend in the longitudinal direction, where the first leg 112 and the second leg 114 are spaced apart from one another in the lateral direction. A plurality of rollers 116 are coupled to the first leg 112 and the second leg 114. In particular, a pair of the plurality of rollers 116 may be coupled to the first leg 112 and a pair of the plurality of rollers 116 may be coupled to the second leg 114. The plurality of rollers 116 are rotatably coupled to the first leg 112 and the second leg 114 such that the plurality of rollers 116 rotate with respect to the first leg 112 and the second leg 114 to facilitate movement of the adaptive lift 100 across a surface, such as a floor.

The adaptive lift 100 includes at least one weldment 120 that is coupled to the first leg 112 and/or the second leg 114. In particular, the weldment 120 may be coupled to a first outward-facing surface 113 of the first leg 112 and another weldment 120 may be coupled to a second outward-facing surface 115 (FIG. 2) of the second leg 114. Alternatively, the weldments 120 may be integrally formed with the first outward-facing surface 113 of the first leg 112 and/or the second outward-facing surface 115 of the second leg 114. Each of the weldments 120 may selectively and severally couple medical equipment to the adaptive lift 100, such as a monitor stand 190 as shown in FIG. 1, an intravenous solution stand (not depicted), or other medical equipment.

The lift portion 130 includes the mast 132 that is coupled to and extends upward from the base portion 110 in the vertical direction. In particular, the mast 132 is coupled to the first leg 112 and the second leg 114. In the embodiment depicted in FIG. 1, the mast 132 is centrally positioned between the first leg 112 and the second leg 114 in the lateral direction. The mast 132 may also be centrally positioned on the first leg 112 and the second leg 114 in the longitudinal direction such that at least a portion of the first leg 112 and the second leg 114 extend forward of the mast 132 in the longitudinal direction (i.e., in the −X-direction) and at least a portion of the first leg 112 and the second leg 114 extend rearward of the mast 132 in the longitudinal direction (i.e., in the +X-direction). At positions forward of the mast 132 in the longitudinal direction, the first leg 112 and the second leg 114 are spaced apart from one another by a distance 10 in the lateral direction. At positions that are proximate to the mast 132 in the longitudinal direction, the first leg 112 and the second leg 114 are spaced apart from one another by a distance 12 in the lateral direction, where the distance 10 is greater than the distance 12. Accordingly, the first leg 112 and the second leg 114 splay outward from each other forward of the mast 132, such that a patient may be positioned and may walk between the first leg 112 and the second leg 114 at positions forward of the mast 132 in the longitudinal direction. Additionally, the splayed shape of the first leg 112 and the second leg 114 may allow multiple adaptive lifts 100 to be stored in a nested configuration (not depicted).

The lift portion 130 includes a pair of support arms 136 that are pivotally coupled to the mast 132. The support arms 136 are positioned above the base portion 110 in the vertical direction and are spaced apart from one another in the lateral direction such that a patient may stand between and grasp onto the support arms 136. The support arms 136 are repositionable between a stowed position (not depicted) and a support position, as shown in FIG. 1. In the support position, the support arms 136 extend forward from the mast 132 in the longitudinal direction. The support arms 136 are pivotally coupled to the mast 132 at a support arm pivot joint 138, and the support arms 136 pivot with respect to the mast 132 about the support arm pivot joint 138. In particular, the support arms 136 pivot about the support arm pivot joint 138 in a direction 20 such that the support arms 136 may be repositioned from the support position to the stowed position, such that multiple adaptive assists may be stored in a nested configuration.

Figure 2:
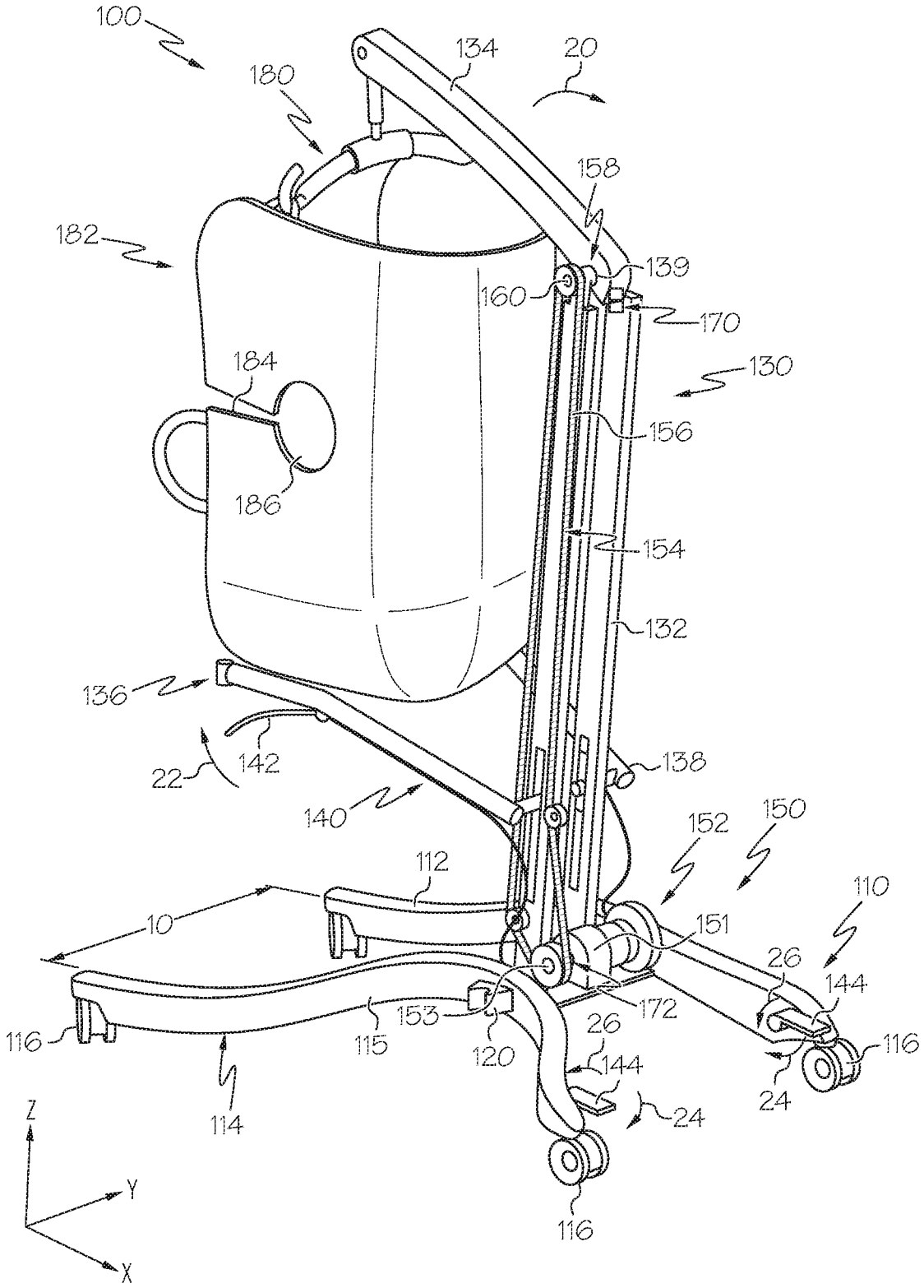
FIG. 2 schematically depicts a rear perspective view of the adaptive mobility lift of FIG. 1 and a lift system according to one or more embodiments shown or described herein.

Referring to FIG. 2, the adaptive lift 100 includes a braking system 140 that is coupled to the support arms 136. The braking system 140 includes a release handle 142 coupled to the support arms 136 such that a user or patient may grasp the release handle 142. The release handle 142 is coupled to the plurality of rollers 116 such that the release handle 142 selectively applies a force to prevent rotation of the plurality of rollers 116. In embodiments, the braking system 140 may include various components to couple the release handle 142 to the plurality of rollers 116, including, but not limited to, bowden cables, mechanical connectors, rods, hydraulic hoses, or the like.

In embodiments, the braking system 140 further includes one or more foot pedals 144 coupled to the first leg 112 and/or the second leg 114. The foot pedals 144 are coupled to the plurality of rollers 116 such that the foot pedals 144 selectively apply a force to the plurality of rollers 116 to prevent rotation of the plurality of rollers 116.

The braking system 140 is repositionable between an engaged position and a disengaged position. In particular, a user or patient may grasp the release handle 142 and pull the release handle 142 toward the support arms 136 in direction 22 to reposition the braking system 140 from the engaged position to the disengaged position. In the disengaged position, the plurality of rollers 116 may rotate freely, allowing the adaptive lift 100 to move over a surface, such as a floor. When the user or patient releases the release handle 142, the braking system 140 is repositioned from the disengaged position into the engaged position. In the engaged position, the braking system 140 prevents rotation of the plurality of rollers 116, thereby restricting movement of the adaptive lift 100 across a surface, such as a floor.

Alternatively or in addition to the release handle 142, the foot pedals 144 reposition the braking system 140 into the engaged position. For example, a user such as a rehabilitation specialist, may step on at least one of the foot pedals 144 and rotate the foot pedal or foot pedals 144 in direction 24 to position the braking system 140 into the engaged position, thereby preventing rotation of the rollers 116 and restricting movement of the adaptive lift 100 across a surface, such as a floor. The user may release the foot pedal 144 rotating the foot pedal 144 in direction 26. While direction 24 and direction 26 are depicted as the clockwise direction and the counterclockwise direction, respectively, it should be understood that the foot pedals 144 may move or rotate in any suitable direction to change the braking system 140 between the engaged position and the disengaged position.

In embodiments of the braking system 140 that include both the release handle 142 and the foot pedals 144, the foot pedals 144 may engage the braking system 140 regardless of the position of the release handle 142. In other words, when the user or rehabilitation specialist rotates the foot pedal 144 to engage the braking system 140, the braking system 140 may remain engaged until the user or rehabilitation specialist releases the foot pedal 144, regardless of the position of the release handle 142. In this way, a rehabilitation specialist may engage the braking system 140 to stabilize and control the position of the adaptive lift 100 when assisting a patient between various positions.

The adaptive lift 100 includes the lift arm 134 that is coupled to the mast 132. The lift arm 134 is pivotally coupled to the mast 132 at a lift arm pivot joint 139 such that the lift arm 134 pivots with respect to the mast 132 in direction 20. By pivoting with respect to the mast 132, a lift end 135 of the lift arm 134 may be raised and lowered with respect to the base portion 110 of the adaptive lift 100 in the vertical direction. Additionally, the lift arm 134 may be repositioned between a support position, as depicted in FIG. 2, and a stowed position (not depicted). To reposition the lift arm 134 from the support position to the stowed position, the lift arm 134 rotates in direction 20 such that multiple adaptive lifts 100 be stored in a nested configuration (not depicted).

A lift bar 180 is coupled to the lift end 135 of the lift arm 134. The lift bar 180 is severally coupled to the lift end 135 of the lift arm 134, and may couple a sling 182 to the lift end 135 of the lift arm 134. The sling 182 accommodates a patient and can be utilized to lift and/or support a patient in various activities, for example lifting a patient from a sitting position to a standing position, assisting a patient from a standing position to a sitting position, and assisting a patient walking. In embodiments, the sling 182 includes one or more access holes 186 to accommodate a patient's arms and legs. The sling 182 may further include one or more seams 184 that are connected to the access holes 186, where sling 182 may be selectively separated along the seams 184 to allow a patient to position their arms and/or legs in the access holes 186. In embodiments, the seams 184 may include a variety of fasteners, including but not limited to, zippers, hook and loop straps, buttons, or the like.

The adaptive lift 100 includes a lift system 150 that facilitates movement of the lift bar 180 and the sling 182 with respect to the base portion 110. The lift system 150 includes a motor 152, a linking member 154 coupled to the motor 152, and a driven member 158 that is coupled to both the linking member 154 and the lift arm 134.

The motor 152 includes a motor base 151 that is coupled to the base portion 110 of the adaptive lift 100 and may be positioned between the first leg 112 and the second leg 114. Alternatively or additionally, the motor base 151 may be coupled to the mast 132 of the adaptive lift 100. The motor 152 includes a motor shaft 153 that rotates with respect to the motor base 151. The motor 152 may include an electrical motor, such as an AC motor, DC motor, a reduction gear motor, or the like.

The linking member 154 is coupled to the motor shaft 153 of the motor and extends between the motor 152 and the driven member 158. In the embodiment depicted in FIG. 2, the linking member 154 includes a chain 156 that extends upwards from the base portion 110 between the motor 152 and the driven member 158. The driven member 158 includes a sprocket 160 that is engaged with the linking member 154 such that when the motor 152 causes the linking member 154 to rotate, the linking member 154 causes the driven member 158 to rotate. Alternatively, the linking member 154 and the driven member 158 may include a belt and a pulley, respectively, that are coupled to the motor 152, such that when the motor 152 causes the linking member 154 to rotate, the linking member 154 causes the driven member 158 to rotate.

The driven member 158 is coupled to the lift arm 134 such that when the driven member 158 rotates, the driven member 158 causes the lift arm 134 to rotate, for example in direction 20 to lift the lift end 135 of the lift arm 134 with respect to the base portion 110. As described above, the lift bar 180 is severally coupled to the lift arm 134, and accordingly is severally coupled to the lift system 150 through the lift arm 134. As the lift arm 134 rotates, the lift end 135 of the lift arm 134 is raised or lowered with respect to the base portion 110, thereby raising or lowering the lift bar 180 with respect to the base portion 110. Accordingly, through the motor 152, the linking member 154, and the driven member 158, the lift system 150 may selectively raise or lower the lift bar 180 of the adaptive lift 100 with respect to the base portion 110 in the vertical direction.

In embodiments, the motor 152 and/or the driven member 158 may include a one-way ratchet 172 that may selectively prohibit lowering the lift bar 180 in the vertical direction. In particular, when engaged, the one-way ratchet 172 may allow the driven member 158 to rotate in a first direction to raise the lift bar 180 in the vertical direction, but may prohibit the driven member 158 from rotating in a second direction to lower the lift bar 180 in the vertical direction, for example when the adaptive lift 100 is utilized to assist a patient between a sitting position and a standing position, as will be described in greater detail herein.

The lift arm 134 includes a position sensor 170 coupled to the lift arm 134 that detects the position of the lift arm 134 with respect to the mast 132. As the lift bar 180 is coupled to the lift end 135 of the lift arm 134, the position of the lift arm 134 with respect to the mast 132 may be indicative of the position of the lift bar 180 with respect to the base portion 110 in the vertical direction. Alternatively or additionally, the motor 152 may include a position sensor 170 that detects the rotational position of the linking member 154 and/or the motor shaft 153 with respect to the motor base 151. As the lift bar 180 is coupled to the linking member 154 and the motor shaft 153 of the motor 152 through the lift arm 134 and the driven member 158, the rotational position of the linking member 154 and/or the motor shaft 153 may be indicative of the position of the lift bar 180 with respect to the base portion 110 in the vertical direction. In embodiments, the position sensor 170 may include various position detection devices, including, but not limited to, a rotary encoder, a string potentiometer, a linear variable differential transducer (LVDT), a proximity sensor, or the like.

Figure 3:
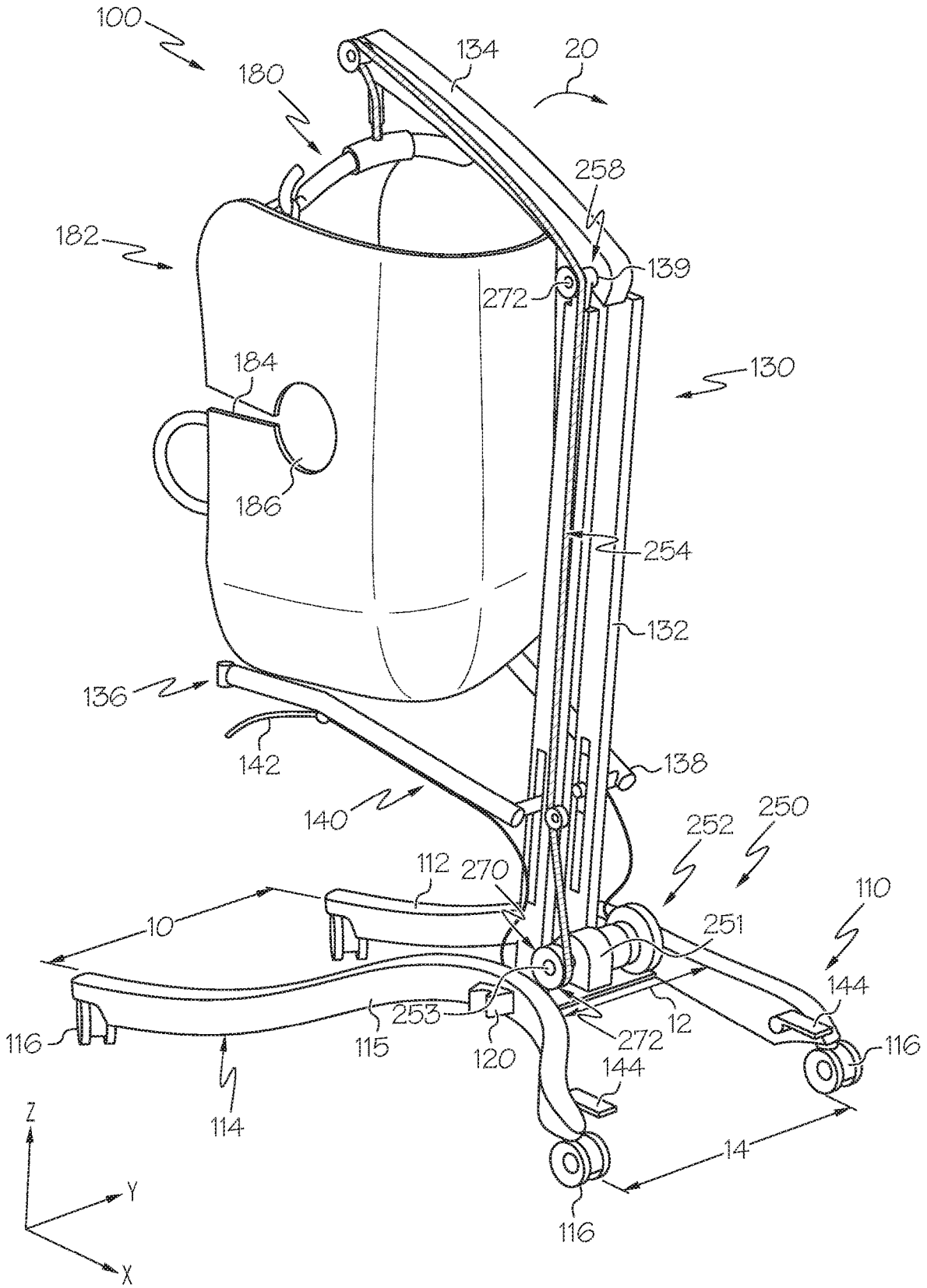
FIG. 3 schematically depicts a rear perspective view of the adaptive mobility lift of FIG. 1 and another lift system according to one or more embodiments shown or described herein.

Referring to FIG. 3, another embodiment of a lift system 250 for the adaptive lift 100 is depicted. In this embodiment, the lift system 250 includes a motor 252 and a linking member 254 that is coupled to the motor 252 and the lift bar 180. Similar to the embodiment depicted in FIG. 2, the motor 252 includes a motor base 251 that is coupled to the base portion 110 of the adaptive lift 100 and may be positioned between the first leg 112 and the second leg 114. Alternatively or additionally, the motor base 251 may be coupled to the mast 132 and/or the lift arm 134 of the adaptive lift 100. The motor 252 includes a motor shaft 253 that rotates with respect to the motor base 251. The motor 252 may include an electrical motor, such as an AC motor, DC motor, a reduction gear motor or the like.

The linking member 254 is coupled to the motor shaft 253 of the motor 252 and is directly and severally coupled to the lift bar 180. In embodiments, the linking member 254 is formed from a belt, a strap, a chain or the like. The linking member 254 extends upward from the motor 252, forward of the mast 132 along the lift arm 134, and downward to the lift bar 180. When the motor 252 rotates, the linking member 254 may be paid out from or drawn in to the motor 252, thereby raising or lowering the lift bar 180 with respect to the base portion 110. In the embodiment depicted in FIG. 3, the lift arm 134 may also rotate in direction 20 to raise or lower the lift bar 180 or may remain stationary as the linking member 254 is paid out or drawn up.

In embodiments, the motor 252 and/or the driven member 258 may include a one-way ratchet 272 that may selectively prohibit lowering the lift bar 180 in the vertical direction. In particular, when engaged, the one-way ratchet 272 may allow the driven member 258 to move in a first direction to raise the lift bar 180 in the vertical direction, but may prohibit the driven member 258 from moving in a second direction to lower the lift bar 180 in the vertical direction, for example when the adaptive lift 100 is utilized to assist a patient between a sitting position and a standing position, as will be described in greater detail herein.

The motor 252 includes a position sensor 270 that detects the position of the linking member 254 and/or the rotational position of the motor shaft 253 with respect to the motor base 251 of the motor 252. As the lift bar 180 is coupled to the linking member 254, the position of the linking member 254 and/or the motor shaft 253 may be indicative of the position of the lift bar 180 with respect to the base portion 110 in the vertical direction. Alternatively or additionally, the lift arm 134 and/or mast 132 may include a position sensor 270 coupled to the lift arm 134 and/or the mast 132 that detects the position of the linking member 254 with respect to the lift arm 134 and/or the mast 132. As the lift bar 180 is coupled to the linking member 254, the position of the linking member 254 with respect to the lift arm 134 and/or the mast 132 may be indicative of the position of the lift bar 180 with respect to the base portion 110 in the vertical direction. In embodiments, the position sensor 270 may include various position detection devices, including, but not limited to, a rotary encoder, a string potentiometer, a linear variable differential transducer (LVDT), a proximity sensor, or the like.

Figure 4:
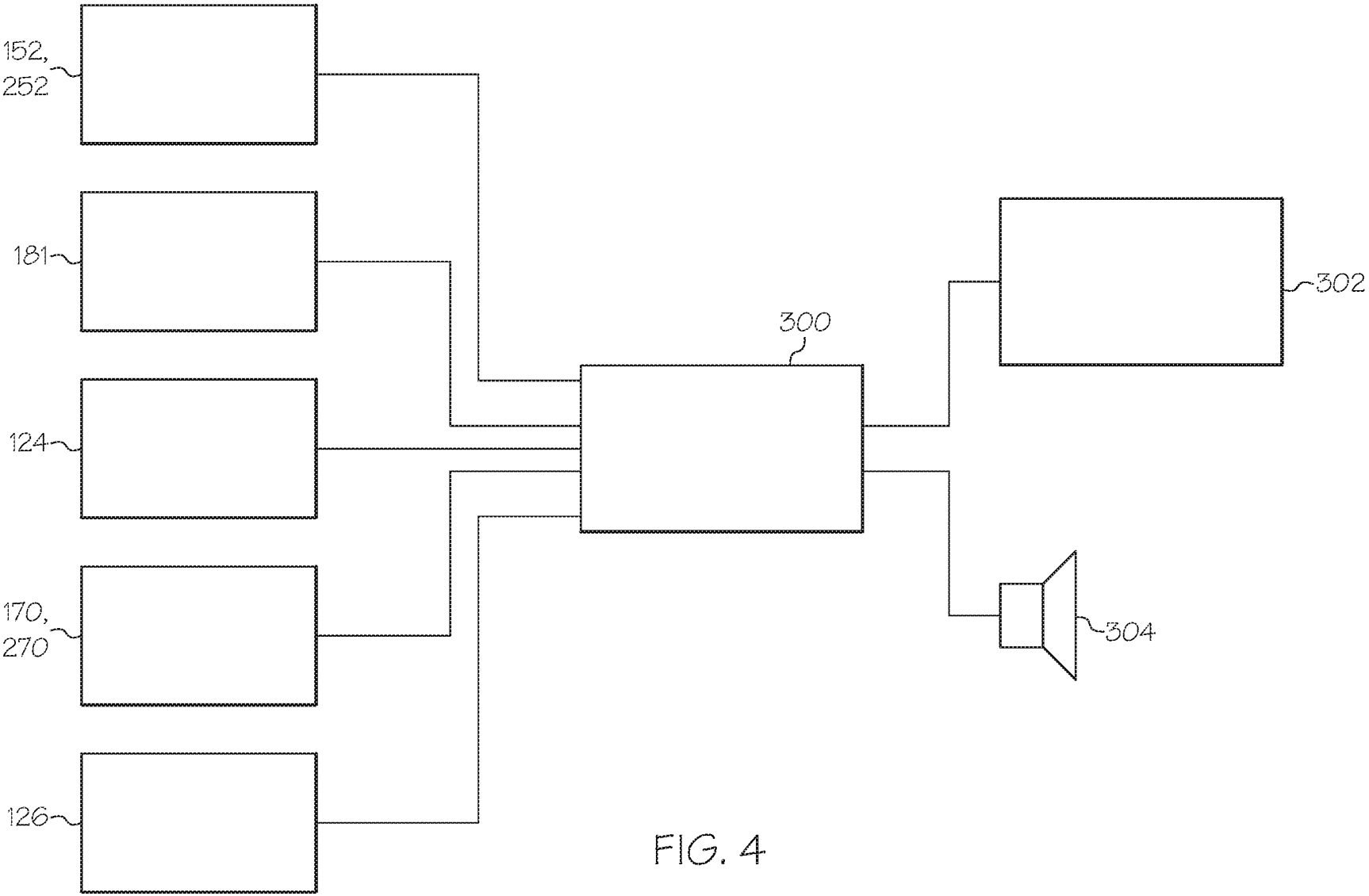
FIG. 4 schematically depicts a block diagram of an electronic controller for use with the adaptive mobility lift of FIG. 1 according to one or more embodiments shown or described herein.

Referring to FIG. 4, the motor 152, 252 is communicatively coupled to an electronic controller 300. The electronic controller 300 includes a processor and a memory storing computer readable and executable instructions, which, when executed by the processor, facilitates operation of the adaptive lift 100.

A user input 124 is communicatively coupled to the electronic controller 300. The user input 124 includes a device that allows a user to input various parameters into the electronic controller 300 to facilitate operation of the adaptive lift 100. For example, a rehabilitation specialist or other healthcare professional may utilize the user input 124 to communicate the weight of a patient to the electronic controller 300 and a desired level of support to be provided by the motor 152, 252, as will be described in greater detail herein. In embodiments, the user input 124 may include various user input devices, including, but not limited to, graphical user interfaces (GUIs), keyboards, or the like.

The lift bar 180 (FIG. 2) includes an integrated scale 181 positioned within the lift bar 180 that is communicatively coupled to the electronic controller 300. The integrated scale 181 may include a load cell, as described in U.S. patent application Ser. No. 14/518,706 filed on Oct. 20, 2014 entitled "Sling Bar or Lift Strap Connector Having an Integrated Scale with Tilt Compensation," the disclosure of which is hereby incorporated by reference. When a patient is positioned in the sling 182, the integrated scale 181 may detect force applied to the lift bar 180 by the patient through the sling 182.

In particular and referring to FIGS. 2 and 4, when a patient is positioned within the sling 182, the patient exerts a downward force in the vertical direction to the sling 182 and accordingly the lift bar 180. The integrated scale 181 of the lift bar 180 detects the downward force applied to the sling 182 by the patient, and based on the downward force applied to the sling 182 by the patient; the integrated scale 181 sends a signal to the electronic controller 300 that is indicative of the force applied to the lift bar 180.

Referring to FIG. 4, the adaptive lift 100 further includes a communications module 302 that is communicatively coupled to the electronic controller 300. The communications module 302 emit a wireless signal that may communicate various parameters from the electronic controller 300 to external databases, such as detected patient weight from the integrated scale 181 and the level of support provided to the patient by the adaptive lift. The communications module 302 may also communicatively couple the electronic controller 300 to a patient support apparatus 400 (FIG. 6), such as a hospital bed or chair, such that the electronic controller 300 may command the patient support apparatus 400 to perform a variety of tasks, such as to raise or lower in the vertical direction, as will be described in greater detail herein.

An acoustic transducer 304 is communicatively coupled to the electronic controller. The acoustic transducer 304 may include an electromechanical element configured to convert electrical energy into mechanical energy such as, but not limited to, a speaker. The electronic controller may cause the acoustic transducer 304 to emit an alert or signal to alert a user that the patient may require additional assistance, as will be described in greater detail herein.

Referring to FIGS. 1 and 4, the adaptive lift 100 includes a call button 126 communicatively coupled to the electronic controller 300. In embodiments, the call button 126 is positioned on one of the support arms 136 such that a patient may access the call button 126 while using the adaptive lift 100. The call button 126 may include an engaged position and a disengaged position and may selectively engage and disengage the acoustic transducer 304. Additionally, the call button 126 may selectively emit a signal from the communications module 302 indicating that the patient requires assistance. The signal emitted by the communications module 302 may then be received by a computing device (not depicted), such as a computer at a nurse's station or a mobile device. The call button 126 may include any suitable manual input device, including, but not limited to, a spring activated pushbutton, a proximity sensor, a capacitive touch sensor, or the like.

Figure 5:
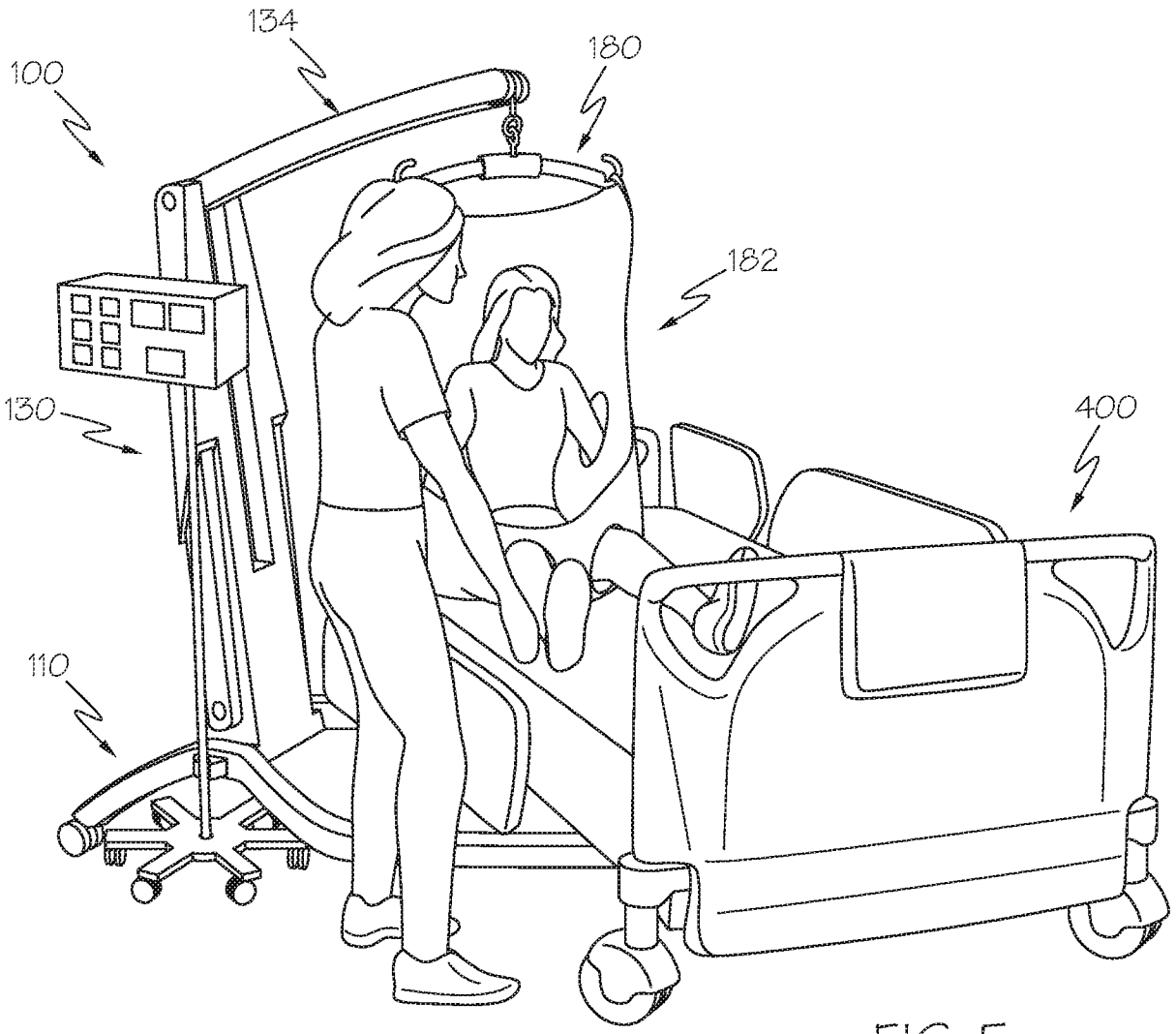
FIG. 5 schematically depicts a perspective view of the adaptive mobility lift of FIG. 1 with a patient in a bed according to one or more embodiments shown or described herein.
Figure 6:
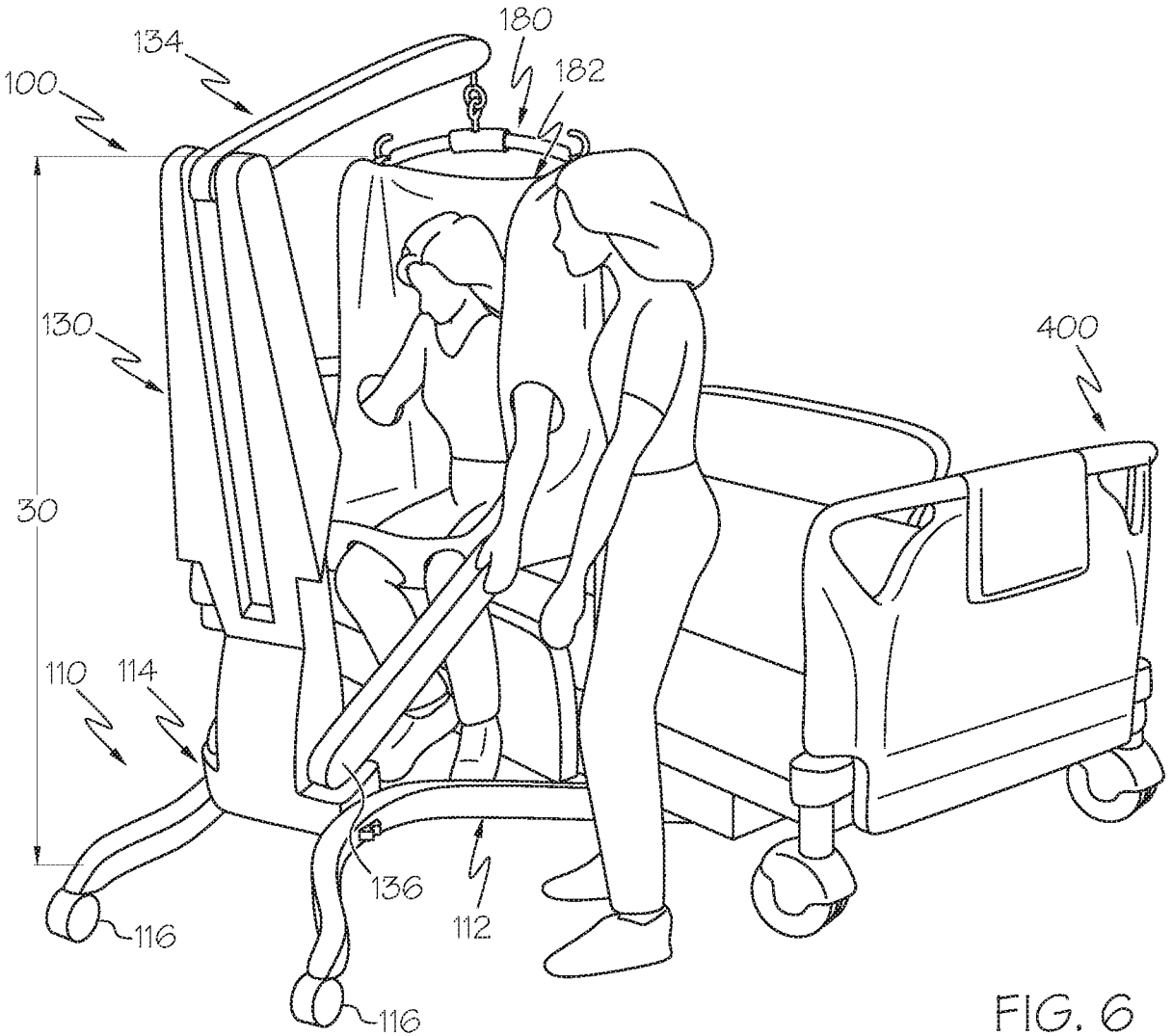
FIG. 6 schematically depicts a perspective view of the adaptive mobility lift of FIG. 1 assisting a patient between a sitting position and a standing position according to one or more embodiments shown or described herein.

Referring to FIGS. 5 and 6, the adaptive lift 100 may be utilized to assist a patient in transferring between a sitting position and a standing position. The patient may initially be positioned in the patient support apparatus 400. A rehabilitation specialist or other healthcare professional may position the patient within the sling 182. The patient may place his/her legs between the first leg 112 and the second leg 114 of the adaptive lift 100 and the patient may grasp and support themselves with the support arms 136.

Figure 7:
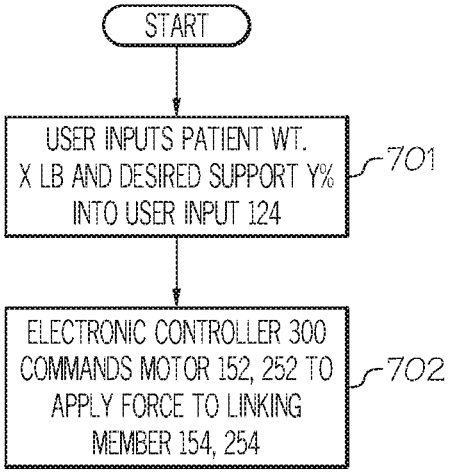
FIG. 7 schematically depicts a flowchart of one embodiment of a method for operating the adaptive mobility lift of FIG. 1 between a sitting position and a standing position according to one or more embodiments shown or described herein.
Figure 10:
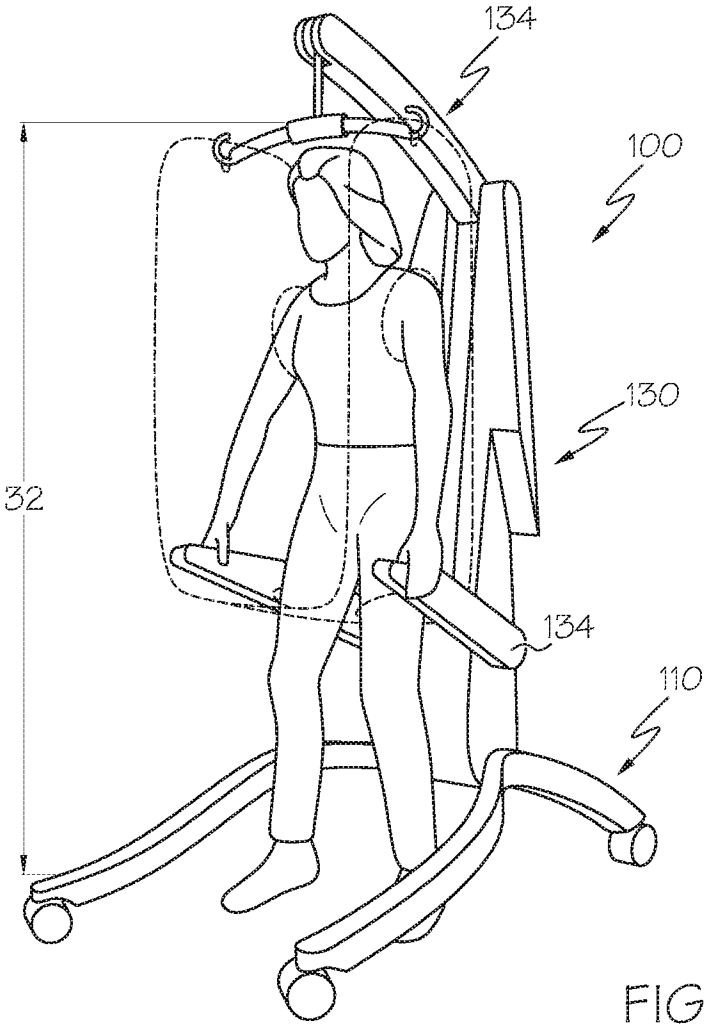
FIG. 10 schematically depicts a perspective view of the adaptive mobility lift of FIG. 1 assisting a patient walking according to one or more embodiments shown or described herein.

Referring to FIGS. 4, 6, 7 and 10, one embodiment of operating the adaptive lift 100 between a sitting position and a standing position is depicted in the flowchart of FIG. 7. When the patient is in the sitting position, as shown in FIG. 6, the lift bar 180 is positioned at a height 30 with respect to the base portion 110 in the vertical direction. As shown in FIG. 10, the adaptive lift 100 raises the lift bar 180 from the sitting position to a standing position in which the lift bar 180 is positioned at a height 32 with respect to the base portion 110 in the vertical direction, where the height 32 is greater than the height 30. In embodiments, the height 30 in the sitting position and the height 32 in the standing position may depending upon various factors, such as the patient's height.

Referring to FIG. 7, in a first step 701, a user may input a patient's mass of X lb and a desired level of support Y % to the user input 124 which sends a signal to the electronic controller 300 indicative of the patient's mass and the desired level of support. In some embodiments, the electronic controller 300 may store the patient's mass of X lb, such that a user may only enter the desired level of support Y % at step 701. Additionally, in some embodiments, the electronic controller 300 may store an initial desired level of support Y % and may successively reduce the desired level of support at a predetermined interval over a set time. For example, for each successive day that a given patient utilizes the adaptive lift 100, the electronic controller 300 may reduced the desired level of support by 5% as the patient develops strength.

At step 702, the electronic controller 300 receives the input mass and desired level of support and executes the computer readable and executable instructions to command the motor 152, 252 to apply torque to the motor shaft 153, 253 which applies a force to the linking member 154, 254 to raise the lift bar 180 upward in the vertical direction. In particular, the motor 152, 252 applies a force to the linking member 154, 254 such that the upward force applied to the lift bar 180 corresponds to the upward force necessary to lift a mass of Z lb, where Z lb corresponds to the input patient mass of X lb multiplied by the desired level of support Y %.

For example, a rehabilitation specialist or healthcare professional may input a patient's mass of 100 lb and a desired level of support of 90% into the user input 124 at step 701. At step 702, the electronic controller 300 then commands the motor 152, 252 to apply torque which applies an upward force to the lift bar 180 that corresponds to the upward force necessary to lift a 90 lb mass (i.e., 100 lb×90%). In some embodiments, the communications module 302 of the adaptive lift may simultaneously command the patient support apparatus 400 to lower in the vertical direction to assist the patient in moving from the sitting position to the standing position.

When the desired level of support is less that 100%, the upward force applied to the lift bar 180 is less that the upward force that is necessary to lift the mass of the patient. Accordingly, in such instances, the lift bar 180 may not move upward when opposed by all of the patient's body weight, such as when the patient is passive. However, as described above, the adaptive lift 100 includes the one-way ratchet 172, 272, which is coupled to the motor 152, 252, and/or the linking member 154, 254. When moving the adaptive lift 100 between the sitting position and the standing position, the one-way ratchet 172 may be engaged such that the one-way ratchet 172 does not allow the lift bar 180 to lower in the vertical direction. In this way, the adaptive lift 100 does not allow the lift bar 180 to lower in the vertical direction, even when the downward force associated with the patient's body weight applied to the lift bar 180 is greater than the upward force applied to the lift bar 180 by the motor 152, 252.

Further, in some embodiments, the position sensor 170, 270 may detect when the lift bar 180 does not move upward in the vertical direction, such as when the patient is passive. When the adaptive lift 100 is moving between the sitting position and the standing position and the lift bar 180 does not move upward, the electronic controller 300 may command the motor 152, 252 to apply force to the linking member 154, 254 such that the lift bar 180 does not lower in the vertical direction. Additionally, the electronic controller 300 may command the communications module 302 and/or the acoustic transducer 304 to emit a signal that the patient may require assistance.

Figure 8:
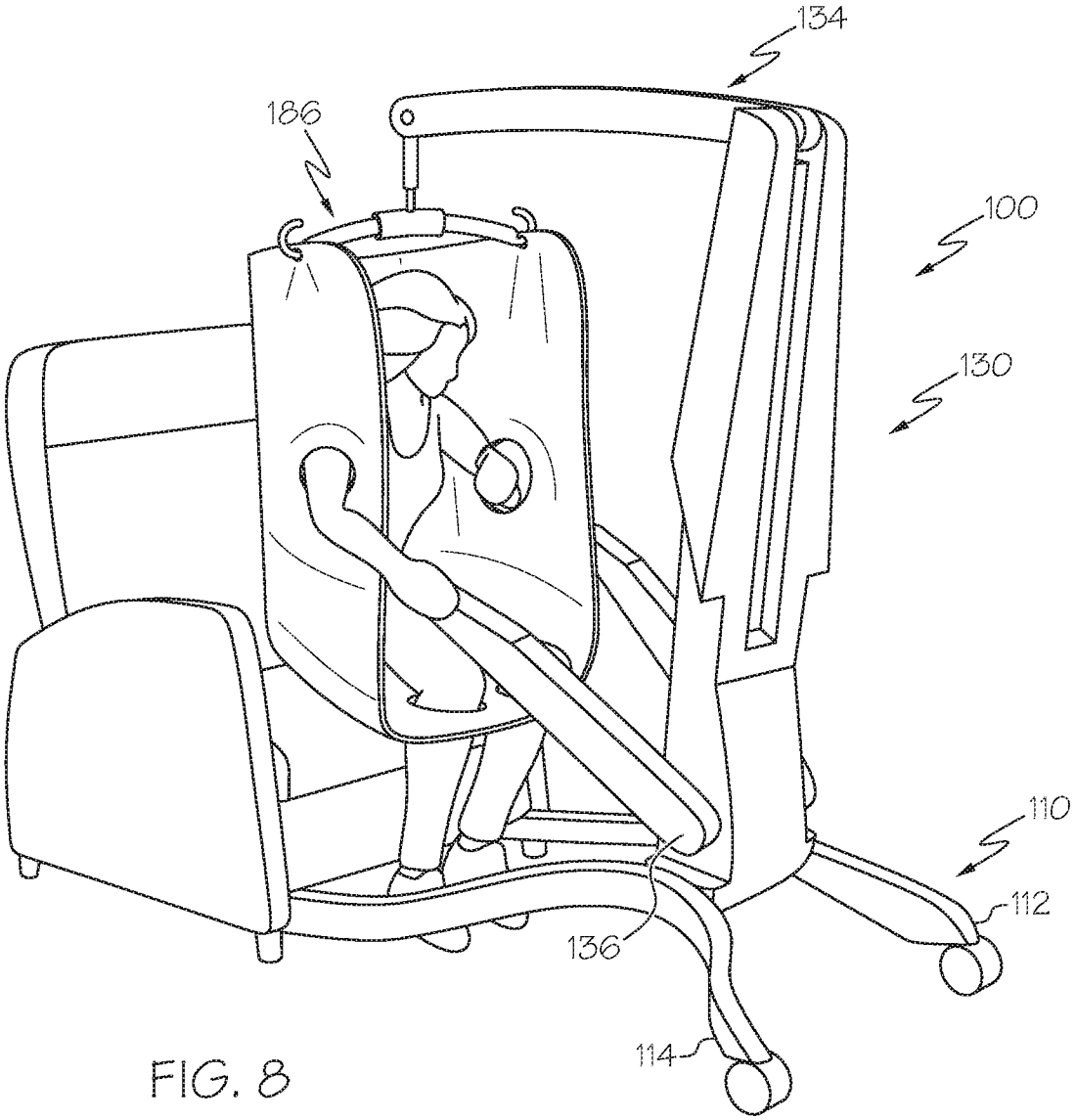
FIG. 8 schematically depicts a perspective view of the adaptive mobility lift of FIG. 1 assisting a patient between a standing position and a sitting position according to one or more embodiments shown or described herein.

When the patient supports themselves such that the downward force associated with the patient's body weight applied to the lift bar 180 is less than the upward force applied to the lift bar 180 by the motor 152, 252, the lift bar 180 moves upward in the vertical direction. The motor 152, 252 continues to apply force to the linking member 154, 254 and accordingly the lift bar 180 until the patient is positioned in the standing position, as depicted in FIG. 10. In embodiments, a user may input a signal to the user input 124 which sends a signal the electronic controller 300 to command the motor 152, 252 to stop rotating once the patient is in the standing position, as depicted in FIG. 8.

In other embodiments, the position sensor 170, 270 may send a signal to the electronic controller 300 indicative of the position of the lift bar 180 in the vertical direction. Once the position sensor 170, 270 detects that the adaptive lift 100 is in the standing position, the electronic controller 300 may command the motor 152, 252 to stop rotating. For example, once the position sensor 170, 270 detects that the lift bar 180 is positioned at the height 32 above the base portion 110 in the vertical direction, the position sensor 170, 270 sends a signal to the electronic controller 300 indicative of the position of the lift bar 180 and the electronic controller 300 commands the motor 152, 252 to stop rotating.

Figure 9:
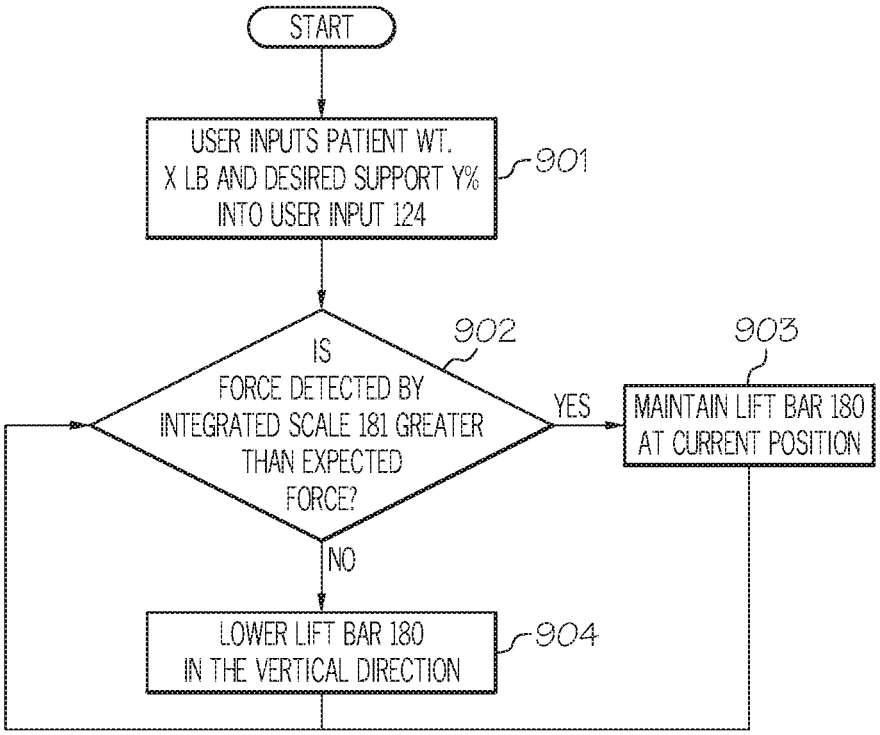
FIG. 9 schematically depicts a flowchart of one embodiment of a method for operating the adaptive mobility lift of FIG. 1 between a standing position and a sitting position according to one or more embodiment shown or described herein.

Referring to FIGS. 4, 6, 8, 9, and 10, one embodiment of a method for moving an adaptive lift 100 from a standing position to a sitting position is depicted in the flowchart of FIG. 9. The adaptive lift 100 lowers the lift bar 180 from the standing position, as shown in FIG. 10, in which the lift bar 180 is positioned at the height 32 with respect to the base portion 110 in the vertical direction, to the sitting position as shown in FIG. 6, in which the lift bar 180 is positioned at the height 30 with respect to the base portion 110 in the vertical direction, where the height 30 is less than the height 32. In embodiments, the height 30 in the sitting position and the height 32 in the standing position may depend upon various factors, such as the patient's height.

Referring to FIG. 9, in a first step 901, a user may input a patient's mass of X lb and a desired level of support Y % to the user input 124 which sends a signal to the electronic controller 300 indicative of the patient's mass and the desired level of support. In some embodiments, the electronic controller 300 may store the patient's mass of X lb, such that a user may only enter the desired level of support Y % at step 901. Additionally, in some embodiments, the electronic controller 300 may store an initial desired level of support Y % and may successively reduce the desired level of support at a predetermined interval over a set time. For example, for each successive day that a given patient utilizes the adaptive lift 100, the electronic controller 300 may reduced the desired level of support by 5% as the patient develops strength. From the patient's mass of X lb and the desired level of support Y %, the electronic controller 300 determines an expected force Z lb applied to the lift bar 180 by the patient, in which the expected force corresponds to the patient's mass of X lb multiplied by the desired level of support Y % (i.e., X lb×Y %).

At step 902, the integrated scale 181 sends a signal to the electronic controller 300 that is indicative of a detected force applied to the lift bar 180, where the detected force applied to the lift bar 180 may be indicative of the downward force applied to the lift bar 180 by the patient as a result of the patient's body weight. If the detected force exceeds the expected force, the electronic controller 300 proceeds to step 903 where the electronic controller 300 commands the motor 152, 252 to apply torque to the motor shaft 153, 253 which applies a force to the linking member 154, 254 to maintain the current position of the lift bar 180.

When the desired level of support is less than 100%, the expected force Z lb is less than the downward force applied to the lift bar 180 under all of the patient's body weight. Accordingly, when the desired level of support is less than 100%, the detected force applied to the lift bar 180 will exceed the expected force Z lb when the patient is passive and applies all of their body weight to the lift bar 180. However, when the patient supports themselves such that the detected force applied to the lift bar 180 is less than the expected force, the electronic controller 300 commands the motor 152, 252 to lower the lift bar 180. In some embodiments, the communications module 302 of the adaptive lift 100 may simultaneously command the patient support apparatus 400 to rise in the vertical direction to assist the patient in moving from the standing position to the sitting position.

In some embodiments, when the adaptive lift 100 is moving between the standing position and the sitting position and the motor 152, 252 applies force to maintain the position of the lift bar 180, the electronic controller 300 may command the communications module 302 and/or the acoustic transducer 304 to emit a signal that the patient may require assistance.

If the detected force does not exceed to the expected force determined at step 901, the electronic controller 300 proceeds to step 904, where the electronic controller 300 commands the motor 152, 252 to lower the lift bar 180 in the vertical direction until the patient is in the sitting position, as shown in FIG. 6. In embodiments, a user may input a signal to the user input 124 which sends a signal the electronic controller 300 to command the motor 152, 252 to stop rotating once the patient is in the sitting position, as depicted in FIG. 6. In other embodiments, the position sensor 170, 270 may send a signal to the electronic controller 300 indicative of the position of the lift bar 180 in the vertical direction. Once the position sensor 170, 270 detects that the adaptive lift 100 is in the sitting position, i.e. is positioned at height 30 in the vertical direction, the electronic controller 300 may command the motor 152, 252 to stop rotating.

Figure 11:
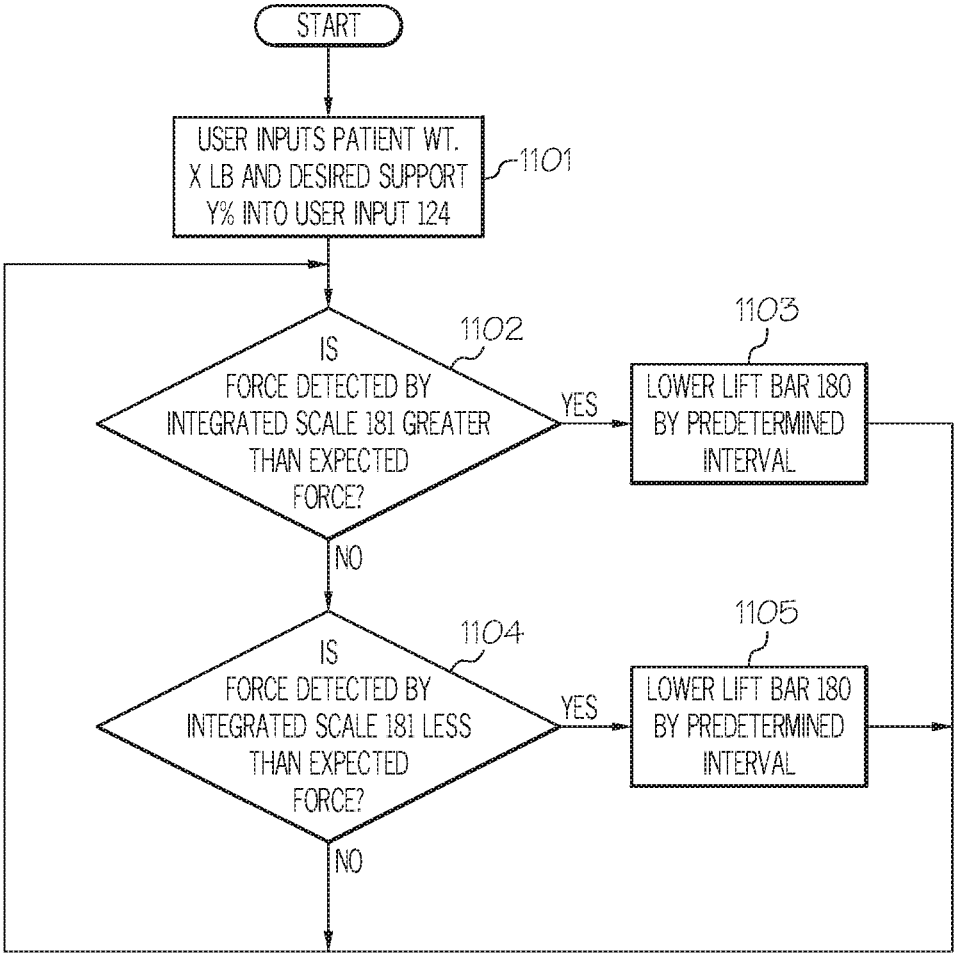
FIG. 11 schematically depicts a flowchart of one embodiment of a method for operating the adaptive mobility lift of FIG. 1 to assist a patient walking according to one or more embodiments shown or described herein.

Referring to FIGS. 4, 10, and 11, one embodiment of a method for assisting a patient in walking is depicted in the flowchart of FIG. 11. The lift bar 180 of the adaptive lift 100 is positioned and maintained in a standing position, as shown in FIG. 10. In embodiments, the height 32 of the lift bar 180 with respect to the base portion 110 in the standing position may depend upon various factors, such as the patient's height.

Referring to FIG. 11, in a first step 1101, a user may input a patient's mass of X lb and a desired level of support Y % to the user input 124 which sends a signal to the electronic controller 300 indicative of the patient's mass and the desired level of support. In some embodiments, the electronic controller 300 may store the patient's mass of X lb, such that a user may only enter the desired level of support Y % at step 1101. Additionally, in some embodiments, the electronic controller 300 may store an initial desired level of support Y % and may successively reduce the desired level of support at a predetermined interval over a set time. For example, for each successive day that a given patient utilizes the adaptive lift 100, the electronic controller 300 may reduced the desired level of support by 5% as the patient develops strength. From the patient's mass of X lb and the desired level of support Y %, the electronic controller 300 determines an expected downward force Z lb applied to the lift bar 180 by the patient, in which the expected force corresponds to the patient's mass of X lb multiplied by the desired level of support Y % (i.e., X lb×Y %).

At step 1102, the integrated scale 181 sends a signal to the electronic controller 300 that is indicative of a detected force applied to the lift bar 180, where the detected force applied to the lift bar 180 may be indicative of the downward force applied to the lift bar 180 by the patient as a result of the patient's body weight. If the detected force exceeds the expected force, the electronic controller 300 proceeds to step 1103 where the electronic controller 300 commands the motor 152, 252 to lower the lift bar 180 by a predetermined interval. In embodiments, the predetermined interval may be less than 6 inches. In other embodiments, the predetermined interval is less than 4 inches. In still other embodiments, the predetermined interval is between 1 inch and 10 inches, inclusive of the endpoints. The electronic controller 300 then proceeds to step 1102 and determines again if the detected force is greater than the expected force.

If the detected force does not exceed to the expected force determined at step 1101, the electronic controller 300 proceeds to step 1104, where the electronic controller 300 commands the motor 152, 252 to lower the lift bar 180 by a predetermined interval. In embodiments, the predetermined interval may be less than 6 inches. In other embodiments, the predetermined interval is less than 4 inches. In still other embodiments, the predetermined interval is between 1 inch and 10 inches, inclusive of the endpoints. The electronic controller 300 then proceeds to step 1102 and determines again if the detected force is greater than the expected force.

In the embodiment depicted in FIG. 11, the steps of determining if the detected force is greater than the expected force (i.e., step 1102) and the step of determining if the detected force is less than the expected force (i.e., step 1104) are described and depicted in a specific order. However, it should be understood that these steps may be performed in any order and may even be performed simultaneously.

When the desired level of support is less than 100%, the expected force is less than the downward force applied to the lift bar 180 under all of the patient's body weight. Accordingly, when the desired level of support is less than 100%, the detected force applied to the lift bar 180 will exceed the expected force when the patient applies all of their body weight or more of their body weight to the lift bar 180 than is expected at the desired level of support. In some instances, the patient may apply all of their body weight or more of their body weight to the lift bar 180 than is expected when the lift bar 180 is positioned at a height that prohibits the patient from supporting themselves. In other words, when the lift bar 180 is positioned too high for a particular patient to support themselves, the patient may apply downward force to the lift bar 180 that exceeds the expected force Z lb. By lowering the lift bar 180 by the predetermined interval when the detected force exceeds the expected force, the adaptive lift 100 may lower the lift bar 180 by the predetermined interval such that the patient can adequately support themselves while walking.

Conversely, when the detected force applied to the lift bar 180 is less than the expected force, the lift bar 180 may be positioned too low to adequately support the patient at the desired level of support. Accordingly, by raising the lift bar 180 by the predetermined interval when the detected force applied to the lift bar 180 is less than the expected force, the adaptive lift 100 may raise the lift bar 180 such that the adaptive lift 100 may provide support at the desired support level.

In embodiments, the distance that the adaptive lift 100 may lower or raise the lift bar 180 in the vertical direction while assisting a patient in walking may be restricted to a defined range, for example based on the patient's height and the shape of the sling 182 (FIG. 2). In embodiments, a user such as a rehabilitation specialist may input or set a walking height for an individual patient, such as the height 32 shown in FIG. 10, into the user input 124. When the adaptive lift 100 is used to assist a patient walking, the lift bar 180 may not be positioned lower than 12 inches below the height 32 (FIG. 10) in the vertical direction, and the lift bar 180 may not be positioned higher than 12 inches above the height 32 in the vertical direction. In other embodiments, the lift bar 180 may not be positioned lower than 6 inches below the height 32 in the vertical direction, and the lift bar 180 may not be positioned higher than 6 inches above the height 32 in the vertical direction.

In some embodiments, the defined range of the vertical position of the lift bar 180 while the adaptive lift 100 is assisting a patient walking may be based directly on an individual patient's height. For example, a user may input the patient's height into the user input 124, and the lift bar 180 may not be positioned lower than the patient's height in the vertical direction. In some embodiments, the lift bar 180 may not be positioned lower than the patient's height in the vertical direction and may not be positioned higher than 24 inches above the patient's height in the vertical direction.

It should now be understood adaptive lifts according to the present disclosure include a braking systems that selectively stabilizes the adaptive lift. In some embodiments, the adaptive lifts include lift systems including an integrated scale communicatively coupled to an electronic controller, in which the integrated scale communicates a detected of force a patient is applying to the adaptive lift. A user, such as a rehabilitation specialist may set a desired level of support provided by the adaptive lift. Using the detected force and the desired level of support, the adaptive lift may assist a patient through certain movements, including moving from a sitting position to a standing position, moving from a standing position to a sitting position, and walking. As the patient regains strength, the rehabilitation specialist may successively reduce the desired level of support, decreasing patient reliance on the adaptive lift.

It is noted that the terms "substantially" and "about" may be utilized herein to represent the inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

What is claimed is:

1. An adaptive lift comprising:

a base portion comprising a plurality of rollers;

a lift portion coupled to the base portion, the lift portion comprising a mast extending upward from the base portion in a vertical direction and a lift arm pivotally coupled to the mast at a first end of the lift arm;

a lift system coupled to the base portion and the lift arm, the lift system comprising a motor coupled to the base portion;

a linking member rotatively engaged with a motor shaft of the motor and extending to and rotatively engaging a driven member non-rotatably coupled to the lift arm at the first end of the lift arm;

a lift bar coupled to the linking member of the lift system and arranged at a second end of the lift arm, opposite the first end, wherein rotation of the linking member raises and lowers the lift bar with respect to the base portion in the vertical direction and causes the driven member to rotate, wherein rotation of the driven member causes the lift arm to rotate;

a support arm pivotally coupled to the mast and positioned above the base portion in the vertical direction; and a braking system coupled to the support arm, the braking system comprising a release handle that selectively repositions the braking system between an engaged position, in which the braking system prevents rotation of the plurality of rollers, and a disengaged position, in which the plurality of rollers may rotate.

2. The adaptive lift of claim 1, wherein the braking system further comprises foot pedals coupled to the plurality of rollers, wherein the foot pedals selectively position the braking system in the engaged position.

3. The adaptive lift of claim 1, wherein the base portion comprises a first leg that extends in a longitudinal direction and a second leg that extends in the longitudinal direction, wherein the first leg and the second leg are spaced apart from each other in a lateral direction.

4. The adaptive lift of claim 1, where in the motor comprises a one-way ratchet that when engaged allows the linking member to move in a first direction while prohibiting the linking member from rotating in a second direction.

5. The adaptive lift of claim 1, wherein the motor comprises a position sensor that detects a position of the linking member with respect to a motor base of the motor.

6. The adaptive lift of claim 1, wherein the lift arm is pivotally coupled to the mast.

7. The adaptive lift of claim 6, further comprising a position sensor coupled to the lift arm, wherein the position sensor detects a position of the lift arm with respect to the mast.

8. An adaptive lift system comprising:

a base portion comprising a plurality of rollers;

a lift portion coupled to the base portion, the lift portion comprising a mast extending upward from the base portion in a vertical direction and a lift arm coupled to the mast;

a lift system coupled to the base portion and the lift arm, wherein the lift system raises and lowers the lift bar with respect to the base portion in the vertical direction, the lift system comprising:

an electronic controller comprising a processor and a memory storing computer readable and executable instructions;

a motor communicatively coupled to the electronic controller;

a linking member rotatively engaged with a motor shaft of the motor and extending to and rotatively engaging a driven member non-rotatably coupled to the lift arm at a first end of the lift arm;

a lift bar coupled to the lift system, the lift bar comprising an integrated scale positioned within the lift bar and communicatively coupled to the electronic controller; and a user input communicatively coupled to the electronic controller.

9. The adaptive lift system of claim 8, wherein when the computer readable and executable instructions are executed by the processor, the lift system:

receives a patient weight and a desired level of support; and commands the motor to apply force to the linking member such that the linking member applies an upward force on the lift bar that corresponds to the patient weight multiplied by the desired level of support.

10. The adaptive lift system of claim 8, wherein when the computer readable and executable instructions are executed by the processor, the lift system:

receives a patient weight and a desired level of support;

determines an expected force that corresponds to the patient weight multiplied by the desired level of support;

detects a detected force applied to the lift bar with the integrated scale;

commands the motor to apply force to the linking member to maintain the lift bar when the detected force exceeds the expected force.

11. The adaptive lift system of claim 10, wherein when the computer readable and executable instructions are executed by the processor, the lift system further commands the motor to lower the lift bar in the vertical direction when the detected force does not exceed the expected force.

12. The adaptive lift system of claim 8, wherein when the computer readable and executable instructions are executed by the processor, the lift system:

receives a patient weight and a desired level of support;

determines an expected force that corresponds to the patient weight multiplied by the desired level of support;

detects a detected force applied to the lift bar with the integrated scale;

commands the motor to lower the lift bar by a predetermined interval in the vertical direction when the detected force exceeds the expected force.

13. The adaptive lift system of claim 8, wherein when the computer readable and executable instructions are executed by the processor, the lift system:

receives a patient weight and a desired level of support;

determines an expected force that corresponds to the patient weight multiplied by the desired level of support;

detects a detected force applied to the lift bar with the integrated scale;

commands the motor to raise the lift bar by a predetermined interval in the vertical direction when the detected force exceeds the expected force.

14. The adaptive lift system of claim 8, further comprising a call button communicatively coupled to the electronic controller.

15. The adaptive lift system of claim 14, further comprising an acoustic transducer communicatively coupled to the electronic controller, wherein the call button selectively engages the acoustic transducer.

16. The adaptive lift system of claim 8, further comprising a communications module communicatively coupled to the electronic controller, wherein the communications module emits a wireless signal.

17. An adaptive lift comprising:

a base portion comprising a plurality of rollers;

a lift portion coupled to the base portion, the lift portion comprising a mast extending upward from the base portion in a vertical direction and a lift arm pivotally coupled to the mast at a first end of the lift arm;

a lift system coupled to the base portion and the lift arm, the lift system comprising a motor coupled to the base portion;

a lift bar coupled to the lift system at a second end of the lift arm, opposite the first end, wherein the lift system raises and lowers the lift bar with respect to the base portion in the vertical direction;

a support arm pivotally coupled to the mast and positioned above the base portion in the vertical direction;

a braking system coupled to the support arm, the braking system comprising a release handle that selectively repositions the braking system between an engaged position, in which the braking system prevents rotation of the plurality of rollers, and a disengaged position, in which the plurality of rollers may rotate; and, a linking member rotatively engaged with a motor shaft of the motor and extending to and rotatively engaging a driven member non-rotatably coupled to the lift arm at the first end of the lift arm, such that rotation of the linking member causes the driven member to rotate, wherein rotation of the driven member causes the lift arm to rotate.

* * * * *